United States Patent [19]

Lechner et al.

[11] 4,048,826

[45] Sept. 20, 1977

[54] DEVICE FOR MANUFACTURING ROTATIONALLY SYMMETRICAL CONSTRUCTIONAL PARTS

[75] Inventors: Manfred Lechner, Munich; Volker Schirm, Brunnthal; Heinrich Dettmann, Ingelfingen, all of Germany

[73] Assignee: Messerschmitt-Bolkow-Blohm, Germany

[21] Appl. No.: 670,821

[22] Filed: Mar. 26, 1976

[30] Foreign Application Priority Data

Apr. 3, 1975 Germany ..... 2514502

[51] Int. Cl.[2] ..... B21F 3/04; B21F 3/10; B21D 11/06

[52] U.S. Cl. ..... 72/21; 72/139; 72/142

[58] Field of Search ..... 72/14, 15, 21, 28, 29, 72/35, 142, 143, 138, 139, 146, 135; 29/157 C, 173

[56] References Cited

U.S. PATENT DOCUMENTS

| | | | |
|---|---|---|---|
| 2,094,204 | 9/1937 | Carter et al. | 72/142 |
| 2,758,629 | 8/1956 | Lewis | 29/173 |
| 3,156,040 | 11/1964 | Drexhage | 29/157 C |
| 3,162,012 | 12/1964 | Blaze et al. | 29/157 C |
| 3,285,518 | 11/1966 | Reid et al. | 29/157 C |

*Primary Examiner*—E. M. Combs
*Attorney, Agent, or Firm*—McGlew and Tuttle

[57] ABSTRACT

The constructional parts have walls formed of elongated juxtaposed tubes, wound spirally about the axis of symmetry of the constructional parts and connected to each other. The tubes are bent to shape by a bending device having at least one bending flank or edge surface conformable to the predetermined 3-dimensional geometry of the part to be manufactured, with one end of each tube being fixed to the bending device and the other end being engaged in a clamping and adjusting device designed as a combined Cardan swivel joint. During bending, the clamping and adjusting device is utilized to continuously control the adjustment parameters of the tube being bent, about three mutually intersecting and perpendicular axes, in conformity with the predetermined three-dimensional geometry of the part, and the radial distance of the swivel joint from the axis of symmetry of the bending device is continuously controlled. A closed-loop control system is provided, and includes an actual-value transmitter, measuring the radial displacement of the swivel joint clamping device relative to the axis of symmetry of the bending device, a reference-value transmitter, having a set point adjusted as a function of the angular displacement between the bending device and the clamping device, and an actuator operating, as a function of the error signal value, to effect radial displacement of the clamping device. The control loop is advantageously designed as an electro-hydraulic system. The control member of the control system may be a cam, or the reference values, which are a function of the angle of rotation, may be determined by means of a digital computer.

10 Claims, 5 Drawing Figures

ε
ε2
ε1
1
2
L6a
β2
β1
3
L6b
δ
6
L1
L6c

ε1
ε
ε2
L1
2
1
2
R1
R2
γ2
3
6
δ2
γ1
L6b
6
L6c
L 12 (L6a)
δ1

17
18
32
38
36
42
ε
1st SIGNAL STAGE
16
22
26
46
MOTOR CONTROL
44
M
34
40
28
2nd SIGNAL STAGE
L12
6
20b
20a
30
P
M
48

DEVICE FOR MANUFACTURING ROTATIONALLY SYMMETRICAL CONSTRUCTIONAL PARTS

CROSS-REFERENCE TO RELATED APPLICATION

The present invention is an improvement upon the device shown, described and illustrated in the copending application of Karl Butter et al, Ser. No. 580141, filed May 23, 1975, for "METHOD AND APPARATUS FOR MANUFACTURING ROTATIONALLY SYMMETRICAL CONSTRUCTIONAL PARTS, SUCH AS NOZZLES AND COMBUSTION CHAMBERS OF ROCKET ENGINES" and assigned to the assignee of the present application, now abandoned and re-filed as application Ser. No. 717,693, filed Aug. 25, 1976.

FIELD AND BACKGROUND OF THE INVENTION

The present invention relates to a device for manufacturing rotationally symmetrical constructional parts having walls formed of juxtaposed tubes which are wound spirally about the axis of symmetry of the constructional part and connected to each other, comprising a bending device, which is provided with at least one bending groove with a bending flank or groove edge surface conformable to the provided three-dimensional geometry of the constructional part to be manufactured, and, associated therewith, a device for clamping and adjusting the free rear end of the tube to be bent which tube has its front end fixed to the bending device, with the adjusting parameters for the tube being continuously controlled, during the bending of the tube along the bending flank, in conformity with the provided three-dimensional geometry of the constructional part to be manufactured, particularly in accordance with such copending U.S. Patent applications assigned to the assignee of this application.

A device of this kind, described in such copending U.S. Patent Applications, comprises a control device for automatically adjusting the radial distance of the clamping device from the central longitudinal axis, or axis of symmetry, of the bending device, and the control device includes an electric control-value transmitter whose set-point is adjustable, by means of a cam, as a function of the angular displacement of the bending device and which is followed by an electrohydraulic control-value receiver activating a hydraulic actuator for a continuous radial displacement of the clamping device.

SUMMARY OF THE INVENTION

The present invention is directed to an improvement in a control device of this kind, ensuring that radial misadjustments of the clamping device are avoided and the preprogrammed, controlled stroke of the actuator, which varies continuously during the bending operation, is exactly observed. For this purpose, in accordance with the present invention, in a device of the kind mentioned in the foregoing, a closed-loop control system is provided, comprising an actual-value transmitter, measuring the radial displacement of the clamping device, a reference-value transmitter, with a set point automatically adjusting as a function of the angular displacement between the bending device and the clamping device, and an actuator, for the radial displacement of the clamping device as a function of the error signal value.

Thus, in accordance with the invention, instead of a simple, error-affected, positive control without feedback, a control system is provided which is responsive to the instantaneous error signal values of the radial stroke of the clamping device, and with which it is ensured that external disturbances, for example, pressure variations in the hydraulic circuit, are compensated and the tube extends always exactly tangentially, from the clamping device to the instantaneous peel-off point on the bending flank or surface without the necessity of a continuous checking, or even a manual readjustment, during the bending operation.

In view of a simple, compact construction and a high reliability in service, the control loop is advantageously designed as an electrohydraulic system in which the reference-value transmitter comprises a first, electric, displacement pickup, which is adapted to be set by means of a control member non-rotatably connected to the bending or the clamping device, the actuator comprises a double-acting hydraulic actuator, which is activated through an electro-valve, and the actual-value transmitter comprises a second, electric, displacement pickup, by which the stroke of the hydraulic actuator is determined. In this embodiment, a constructionally simple, mechanical, preprogramming of the reference values is advantageously obtained by designing the control member as a cam rotatable with the bending device and which is adapted to set the reference-value transmitter by means of a tracer point cam follower.

Instead of providing such a mechanical preprogramming, the reference values, which are a function of the angle of rotation, may also be determined by means of a digital computer. Such a design is advisable primarily for eliminating mechanical tracing errors in cases where the reference values follow a short radius curve as well as in cases where the shape, and the reference values resulting therefrom, vary frequently, because digital computers are re-programmable in a simple manner. In such cases, advantageously, the reference-value transmitter comprises an angle pickup which is provided for measuring the angular displacement between the bending and clamping devices, and which is connected, through an analog-digital converter, to a digital computer in which the reference value is stored or computed as a function of the angular displacement and whose digital output signal, after having passed through a following digital-analog converter, is compared with the output signal of the actual-value transmitter.

In the simplest case, a potentiometer is provided to serve as the electrical displacement pickup. For an exact conversion of the measured values following even small setting motions, however, the displacement pickup is advantageously designed as an inductive plunger-type pickup which is connected, through a signal stage comprising a carrier-frequency oscillator and a detector, to a differential amplifier controlling the electrovalve.

Further, preferably at least one of the displacement pickups is followed by an amplifier, which has the advantage that, by adjusting the degree of amplification, the transformation ratio of the control loop can be determined so that, for example, for bending devices of different sizes but having geometrically similar bending curvatures, it is not necessary to change the shape of the reference-value curve.

An object of the invention is to provide an improved device for manufacturing rotationally symmetrical constructional parts.

Another object of the invention is to provide such a device including a bending device rotatable about an axis of symmetry during bending of a tube, and a clamping device for clamping and adjusting the free rear end of the tube having its front end secured to the bending device.

A further object of the invention is to provide such a device including a closed-loop control system, insuring that radial misadjustments of the clamping device are avoided, and a pre-programmed, controlled stroke of an actuator, controlling the radial adjustment of the clamping device, and which varies continuously during the bending operation, is exactly observed.

For understanding of the principles of the invention, reference is made to the following description of typical embodiments thereof, as illustrated in the accompanying drawings.

DESCRIPTION OF THE PREFERRED EMBODIMENTS

Figure 1:
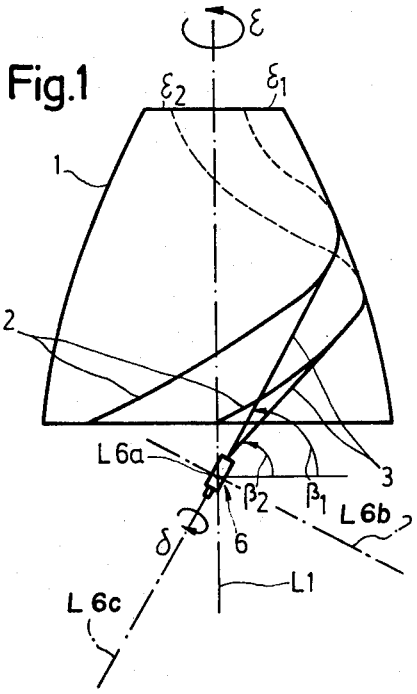
FIGS. 1 and 2 are, respectively, a side elevation view and a top plan view of a bending device, illustrating the bending operation while showing two different angular positions during the bending process.

Bending device 1 comprises a body having a parabolic cross section, in which a bending groove 2 with a bending flank, or groove side or edge surface, 2*a* is milled corresponding to the predetermined three-dimensional geometry of the constructional part to be manufactured. Bending flank 2*a* serves for bending to shape one tube 3 at a time, for which purpose the front or first end of the tube is secured to the upper end of bending device 1 by suitable holding means (not shown) and the rear or other end of the tube is retained by means of a clamping device 6 which is designed as a combined Cardan swivel joint. Cardan joint 6 is mounted on a double action hydraulic cylinder 20*a* for rotation about a first Cardan axis L6*a* and the cylinder is mounted for sliding motion in a straight guideway 12. The longitudinal axis L12 of straight guideway 12 coincides with first Cardan axis L6*a* and extends perpendicularly to and intersects the central longitudinal axis or axis of symmetry, l1 of bending device 1. Clamping device 6 is further pivotable about a second Cardan axis L6*b* which extends at a right angle to first Cardan axis L6*a*. Finally, clamping device 6 makes it possible to turn tube 3, in the torsional direction, about a pivotal axis L6*c* which extends perpendicularly to second Cardan axis L6*b*.

Figure 5:
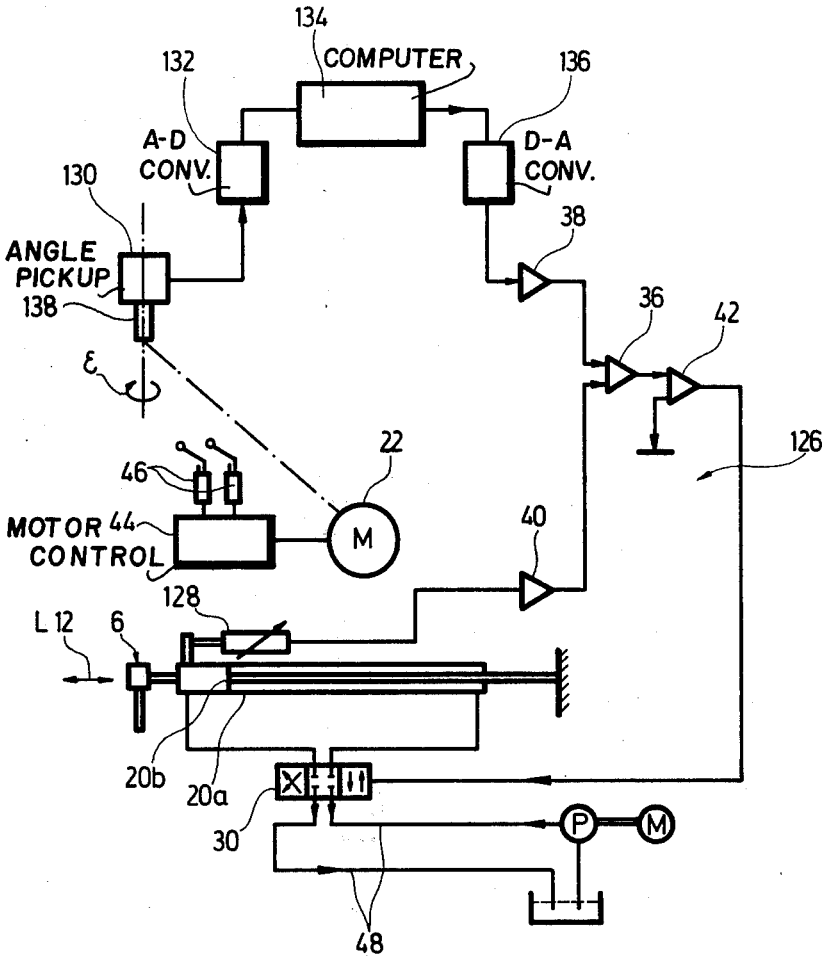
FIG. 5 is an illustration similar to FIG. 4, showing a modified control loop comprising a digital transmission of the reference value.

Clamping device 6 is identical with the clamping device 6 shown, to a larger scale, in FIGS. 5 and 6 of copending applications Serial No. 580,141, now abandoned and Ser. No. 717,693, to which reference has already been made.

Figure 2:
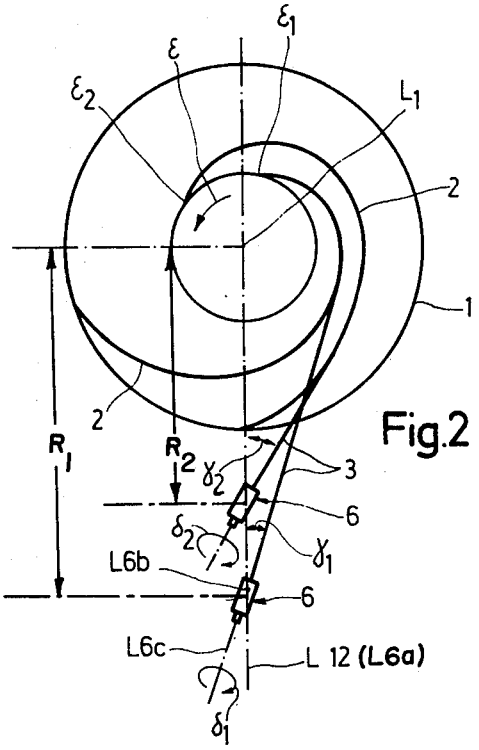

FIGS. 1 and 2 show bending device 1 in two different angular positions $\epsilon_1$ and $\epsilon_2$. For any angle of rotation $\epsilon$, combined Cardan swivel joint 6, along with straight guideway 12, permits an adjustment to tangency of tube 3 along the bending curve by means of a corresponding control of parameters R, $\beta$, $\gamma$ and $\delta$. By controlling the radial position R, as a function of the progressive winding of tube 3 on bending flank 2*a*, the clamping device is continuously positioned at the points of intersection of longitudinal axis L12, of straight guideway 12, and a tangent drawn to the bending curve at the instantaneous peel-off point and, by swinging Cardan joint 6, on the one hand, about first Cardan axis L6*a* through angle of inclination $\beta$ (FIG. 1) and, on the other hand, about second Cardan axis L6*b* through tangential angle $\gamma$ (FIG. 2), the longitudinal axis of the not yet bent tube portion is brought into coincidence with this tangent. Further, for tubes 3 having a non-circular cross section, a turning of clamping device 6 about third axis of rotation L6*c*, through a torsional angle $\delta$, makes it possible to adjust the position of the cross section of the tube relative to the contour of the finished constructional part in a uniform manner, along the entire extension of the bending curve. Thus, with every angle of rotation $\epsilon$, a set of control parameters is associated.

While parameters $\beta$, $\gamma$ and, if necessary, $\delta$ may be adjusted manually, the adjustment of radial position R to a respective angle of rotation $\epsilon$ is effected by means of an electro-hydraulic closed-loop control system 26. This system comprises a control cam 16 the contour of which represents, on a reduced scale, the required radial position or displacement R of clamping device 6 along axis L12 as a function of the angle of rotation $\epsilon$. Cam 16 is non-rotatably connected to bending device 1 which is rotatably mounted on a stationary column 21 and driven, through a pinion 24, by an electric motor 22 which is actuated by means of a control 44 and limit switches 46. Cam 16 is continuously traced by a tracer point or cam follower 17 acting on an inductive plunger-type displacement pickup 18 which constitutes, along with a first signal stage 32, comprising a carrier-frequency oscillator and a detector, a reference-value converter whose output signal is delivered, through a first pre-amplifier 38, to one input of a differential amplifier 36.

The controlled variable, thus the radial displacement R of clamping device 6 along axis L12, is determined by an inductive actual-value transmitter 28, comprising a plunger which is connected to double-action hydraulic cylinder 20*a* for moving therewith. Hydraulic cylinder 20*a* is mounted in straight guideway 12 for displacement in longitudinal direction L12 and co-operates with a stationary hydraulic piston 20*b*. Inductive actual-value pickup 28 is sensed by means of a second signal stage 34, again comprising a carrier-frequency oscillator and a detector. The output signal of this second signal stage passes through a second pre-amplifier 40 and is applied to the other input of differential amplifier 36.

By an appropriate adjustment of pre-amplifiers 38, 40, the actual and reference values are brought to the same scale. The result of the comparison of the actual and reference values determines, through a control amplifier 42, the position of an electro-hydraulic valve 30 which, along with a motor-driven pump, is incorporated in a hydraulic circuit 48 and controls the direction and length of the stroke of actuator 20*a*, 20*b*, and thereby also the radial displacement R of clamping device 6. Instead of using the shown three-position control, with a constant stroke velocity of actuator 20*a*, 20*b*, another control characteristic of closed loop 26 may also easily be provided, for example, a continuous control of the volume of hydraulic fluid flowing to and from actuator 20*a*, 20*b*, as a function of the magnitude of the error signal determined in differential amplifier 36.

In the closed-loop control system 126 shown in FIG. 5, where corresponding parts are designated with the same reference numerals, for measuring the actual value, i.e. the stroke of actuator 20*a*, 20*b*, a potentiometer 128 is provided instead of inductive plunger-type displacement pickup 28 and signal stage 34 connected thereafter. The adjustable tap or final control element of potentiometer 128 is connected to hydraulic cylinder 20*a* for moving therewith, and the electric output signal of the potentiometer, corresponding to the stroke of hydraulic cylinder 20*a*, is directly applied to the input of pre-amplifier 40.

Figure 4:
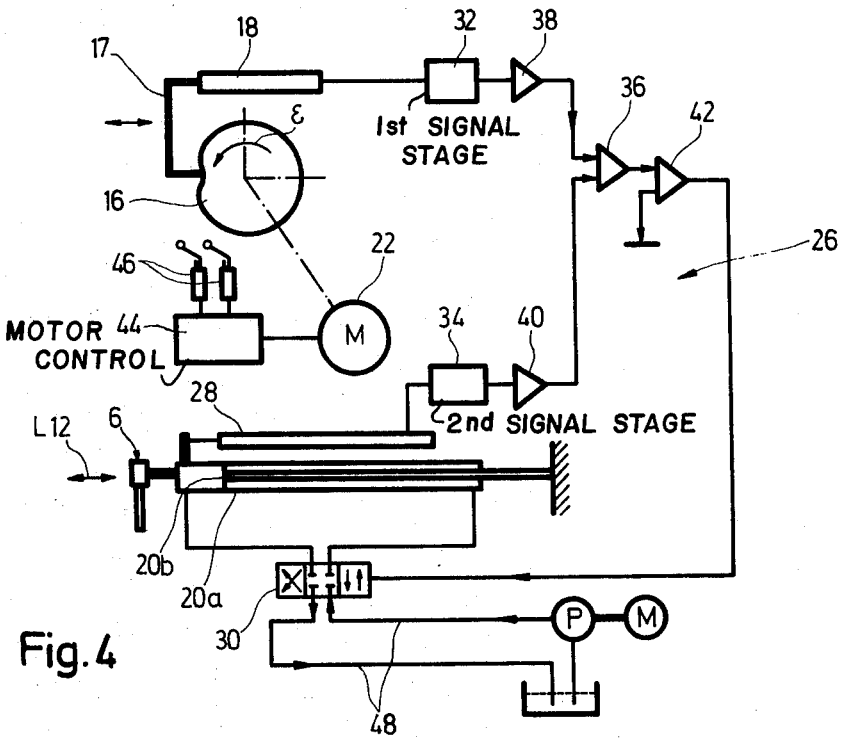
FIG. 4 is a diagrammatical illustration of the closed-loop control system.
Figure 3:
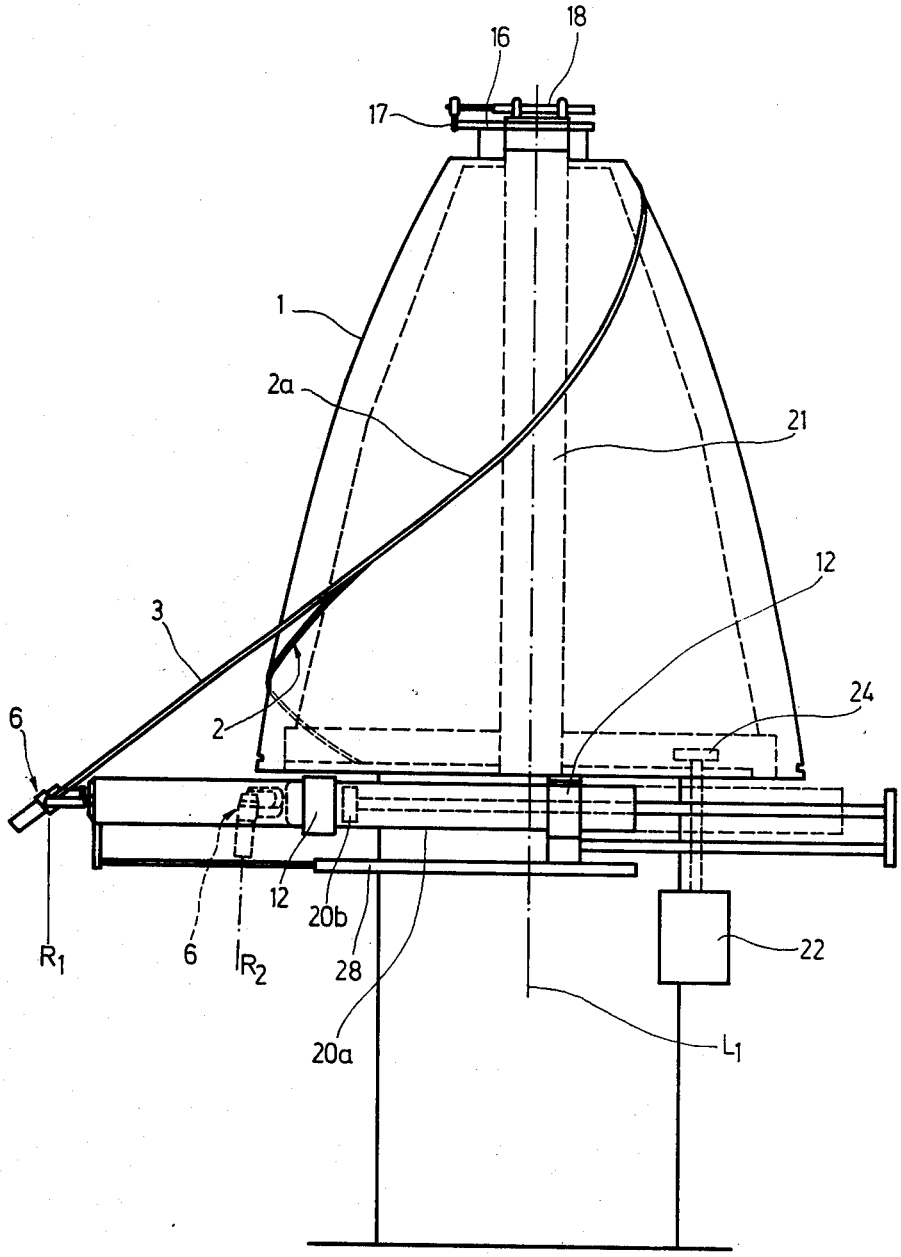
FIG. 3 is a side elevational view of a bending machine.

Control loop 126 operates with a digital transmission of the reference value. In an angle pickup 130, having its control member 138 non-rotatably connected to bending device 1, angle of rotation $\epsilon$ of bending device 1 is converted into an electric analog signal which, after having passed through an analog-digital converter 132, is delivered to a computer 134 wher the reference value associated with the respective angle of rotation $\epsilon$ is computed or stored. The digital output signal of computer 134, representing this reference value, passes through a digital-analog converter 136 and pre-amplifier 38 to differential amplifier 36 where, in the same manner as in control loop 26 according to FIG. 4, it is compared with the output signal of pre-amplifier 40 and causes, through control amplifier 42, a respective positioning of electro-hydraulic valve 30.

The dependency of the reference value on angle of rotation $\epsilon$ can be easily varied by a corresponding reprogramming of computer 134. Also, due to the transmission of the reference value by means of a digital or analog computer, tracing errors, which may occur with a mechanical pickup of the reference value, are avoided.

While specific embodiments of the invention have been shown and described in detail to illustrate the application of the principles of the invention, it will be understood that the invention may be embodied otherwise without departing from such principles.

What is claimed is:

1. In a apparatus for manufacturing a rotationally symmetrical constructional part, with a three-dimensional geometry, having walls formed of elongated tubes wound spirally about the axis of symmetry of the constructional part and connected to each other, with such manufacturing apparatus comprising a rotatable bending device having a central longitudinal axis of symmetry and at least one bending flank conforming to the predetermined three-dimensional geometry of the constructional part to be manufactured, holding means operable to clamp one end of each tube to the bending device for bending the tube to shape by bending it into contact with the bending flank, and a clamping and adjusting device operatively associated with the bending device and operable to clamp the other end of each tube, said clamping and adjusting device being radially displaceable relative to said axis of symmetry and angularly displaceable relative to said bending flank to continuously control the bending of the tube along the bending flank about three mutually intersecting axes, in conformity with such predetermined three-dimensional geometry of the constructional part to be manufactured; the improvement comprising a closed-loop control system for said clamping and adjusting device comprising, in combination, an actual-value transmitter operatively associated with said bending device and said clamping and adjusting device for measuring the radial displacement of said clamping and adjusting device relative to the central longitudinal axis of symmetry of said bending device; a reference-value transmitter operatively associated with said bending device, which is set automatically as a function of the angular displacement between said bending device and said clamping and adjusting device; means deriving an error signal value represented by the difference between the output values of said actual-value transmitter and said reference-value transmitter; and an actuator connected to said clamping and adjustment device and operable to radially displace said clamping and adjusting device as a function of the error signal value.

2. In an apparatus for manufacturing rotationally symmetrical constructional parts, a closed-loop control system, as claimed in claim 1, in which said control system is an electro-hydraulic control system; said reference value transmitter comprising a first, electrical displacement pickup; a control member, non-rotatably connected to one of said bending device and said clamping device, and operatively associated with said first, electrical, displacement pickup to set the latter; said actuator comprising a double-action hydraulic actuator; an electro-hydraulic valve controlling operation of said actuator; said actual-value transmitter comprising a second, electrical displacement pickup determining the longitudinal stroke of said hydraulic actuator; said electro-hydraulic valve being operatively connected to both pickups and controlling displacement of said actuator as a function of the derived error signal value.

3. In an apparatus for manufacturing rotationally symmetrical constructional parts, a closed loop control system as claimed in claim 2, in which said control member comprises a control cam disc; and a tracer point cam follower engaged with said cam disc and operatively connected to said reference-value transmitter.

4. In an apparatus for manufacturing rotationally symmetrical constructional parts, a closed-loop control system, as claimed in claim 2, and which said control member is non-rotatably connected to said bending device.

5. In an apparatus for manufacturing rotationally symmetrical constructional parts, a closed-loop control system, as claimed in claim 2, in which said control member is non-rotatably connected to said clamping device.

6. In an apparatus for manufacturing rotationally symmetrical constructional parts, a closed-loop control system, as claimed in claim 2, in which said reference-value transmitter comprises an angle pickup measuring the angular displacement between said bending device and said clamping device; an analog-digital converter connected to said angle pickup; a digital computer connected to said analog-digital converter and storing the reference value as a function of such angular displacement; a digital-analog converter connected to said computer to receive the output signal thereof; and means connected to said digital-analog converter and said actual-value transmitter and operable to compare the digital output signal with output signal of said actual-value transmitter.

7. In an apparatus for manufacturing rotationally symmetrical constructional parts, a closed-loop control system, as claimed in claim 2, in which said reference-value transmitter comprises an angle pickup measuring the angular displacement between said bending device and said clamping device; an analog-digital converter connected to said angle pickup; a digital computer connected to said analog-digital converter and computing the reference value as a function of such angular displacement; a digital-analog converter connected to said computer to receive the output signal thereof; and means connected to said digital-analog converter and said actual-value transmitter and operable to compare the digital output signal with output signal of said actual-value transmitter.

8. In an apparatus for manufacturing rotationally symmetrical constructional parts, a closed-loop control system, as claimed in claim 2, in which at least one of said displacement pickups is constituted by a potentiometer.

9. In an apparatus for manufacturing rotationally symmetrical constructional parts, a closed-loop control system, as claimed in claim 2, in which at least one of said displacement pickups is constituted by an inductive plunger-type displacement pickup; a differential amplifier connected in controlling relation with said electro-hydraulic valve; respective signal stages connecting each displacement pickup to said differential amplifier; at least the signal stage connecting said inductive plunger-type displacement pickup to said differential amplifier being constituted by a carrier-frequency oscillator and a detector.

10. In an apparatus for manufacturing rotationally symmetrical constructional parts, a closed-loop control system, as claimed in claim 9, including respective amplifiers connecting each displacement pickup to said differential amplifier.

* * * * *